US009688297B2

(12) United States Patent
Ryan

(10) Patent No.: US 9,688,297 B2
(45) Date of Patent: Jun. 27, 2017

(54) VIRTUAL RAILROAD CROSSING ALERT

(71) Applicant: Michael C. Ryan, Mitchellvile, IA (US)

(72) Inventor: Michael C. Ryan, Mitchellvile, IA (US)

( * ) Notice: Subject to any disclaimer, the term of this patent is extended or adjusted under 35 U.S.C. 154(b) by 69 days.

(21) Appl. No.: 14/856,556

(22) Filed: Sep. 17, 2015

(65) Prior Publication Data

US 2016/0229435 A1 Aug. 11, 2016

Related U.S. Application Data

(60) Provisional application No. 62/050,958, filed on Sep. 16, 2014.

(51) Int. Cl.

| | |
|---|---|
| ***B61L 25/00*** | (2006.01) |
| ***B61L 29/24*** | (2006.01) |
| ***B61L 25/02*** | (2006.01) |
| ***B61L 15/00*** | (2006.01) |
| ***B61L 21/10*** | (2006.01) |

(52) U.S. Cl.

CPC ..... *B61L 29/24* (2013.01); *B61L 15/009* (2013.01); *B61L 15/0027* (2013.01); *B61L 21/10* (2013.01); *B61L 25/025* (2013.01); *B61L 2205/04* (2013.01)

(58) Field of Classification Search

CPC ..... B61L 29/24; B61L 29/246; B61L 29/18; B61L 29/00; B61L 29/32; B61L 25/025; B61L 25/02; B61L 25/021; B61L 2205/04; B61L 1/188; B61L 27/0088; B61L 3/221

See application file for complete search history.

(56) References Cited

U.S. PATENT DOCUMENTS

| | | | | |
|---|---|---|---|---|
| 6,179,252 | B1 * | 1/2001 | Roop | B61L 29/18 246/122 R |
| 7,315,770 | B2 * | 1/2008 | Wade | B61L 29/00 246/1 R |
| 7,769,544 | B2 * | 8/2010 | Blesener | B61L 29/28 246/124 |
| 7,772,996 | B2 * | 8/2010 | Burns | G08G 1/164 340/988 |
| 8,126,479 | B2 * | 2/2012 | Morrison | G06Q 30/02 455/456.3 |
| 8,838,301 | B2 * | 9/2014 | Makkinejad | B61L 25/025 246/3 |
| 2013/0048795 | A1 * | 2/2013 | Cross | B61L 15/0027 246/122 R |
| 2013/0194423 | A1 * | 8/2013 | Baines | B61L 29/28 348/148 |
| 2014/0263857 | A1 * | 9/2014 | Huntimer | B61L 25/025 246/122 R |
| 2016/0189552 | A1 * | 6/2016 | Hilleary | G08G 7/02 246/125 |
| 2016/0229435 | A1 * | 8/2016 | Ryan | B61L 29/24 |

* cited by examiner

*Primary Examiner* — Jason C Smith
(74) *Attorney, Agent, or Firm* — Prudens Law LLC

(57) ABSTRACT

System and method for a virtual crossing alert system that provides a notification, an alert, or a command to an alert receiving system depending on the spatial relationships of actors within a specified area.

1 Claim, 7 Drawing Sheets

412
WIFI ANTENNA
CREATES CROSSING
"HOT SPOT"
411
FLASHING
WARNING
LIGHTS
RAIL ROAD
CROSSING
1
TRACKS
RAIL ROAD
CROSSING
1
TRACKS
CLEAR PASSAGE
150 FT.
406
DO NOT
STOP
ON
TRACKS
406
DO NOT
STOP
ON
TRACKS
402
BNSF RR
CROSSING 244
N 117
401
AUDIBLE
ALERT SOUND
GENERATORS
410
MINS/HRS
CLEAR
406
TIME: 2:46:38PM

410
Audible Alert Sound Generators
MINS/HRS
ARRIVAL
Freight Train
Avg Speed 62MPH.
Crossing Closed Time
406
TIME: 2:14:38PM
RAIL ROAD CROSSING
1 TRACKS
405
STOP DON'T ENTER
150FT.
R
DO NOT STOP ON TRACKS
403
404
BNSF RR
Crossing 241
N 117
1,354FT.
CAUTION-
ON COMING TRAIN
SLOW DOWN
45MPH
406
412
Wifi Antenna
Creates Crossing "Hot Spot"
411
Flashing Warning Lights

VIRTUAL RAILROAD CROSSING ALERT

PRIORITY CLAIM

The present invention claims priority to and the benefit of U.S. Provisional Application No. 62/050,958, the contents of which are incorporated herein by reference.

TECHNICAL FIELD

The present invention is generally related to transportation safety. More particularly, the present invention pertains to a system and method for facilitating a warning and alert system at railroad, or other similar, crossing.

BACKGROUND

Railroads must contend with enormous liability related to their various railroad crossings around the clock, every day of the year. Railroads have the right of way of travel. Anyone must yield to rail traffic when approaching a railroad crossing. However, railroad crossings remain dangerous. As of 2009, there were 136,041 railroad crossing in the United States. Of that number, over 60,000 had gates, lights, bells and other equipment that must have power provide to them for operation and subsequently maintained. In 2009, 431 people were killed at railroad crossings while 343 were injured on railroad right of ways.

Typically to provide a safer crossing, one solution is to provide more crossing gates, alarms, bells, control circuitry, etc. to more crossings. However, with each more and more installations, costs become prohibitive to maintain the needed equipment.

What is needed is a solution that increases safety of crossings, and therefore, railroad networks but at a fraction of the cost in installation and maintenance.

SUMMARY

While the way in which the present invention addresses the disadvantages of the prior art will be discussed in greater detail below, in general, the present invention for systems and methods improving safety at railroad crossings. The systems and methods provide a warning and alert system by constructing digital zones around various actors within a specified area.

A virtual crossing system comprises one or more networks, a railroad information system, a positioning and mapping system, an alert receiving system, and an integration system wherein the integration system receives train information from the railroad system over the one or more networks and constructs a first digital zone around the train wherein the integration system receives location information from the alert receiving system over the one or more networks and constructs a second digital zone around the alert receiving device, and wherein the integration system issues at least one of an alert, a notification, and a command depending on (i) when the first digital zone intersects the second digital zone or (ii) when the first digital zone is expected to intersect the second digital zone, according to defined parameters.

A method of constructing zones around various actors within a virtual crossing system comprises: for actors within a specified area, receiving at a specially programmed computer, train information from a railroad information system, receiving at the computer, positioning and mapping information, and receiving, at the computer, alert receiving device information. The specially programmed computer digitally constructs zones around each actor in the specified area. When one or more zones intersect, the specially programmed computer issues an alert, a notification, or a command based one or more parameters. An alert receiving device receives the alert, notification, or command and executes an audio, visual, or vibratory action.

Additional features and advantages of the invention will be set forth in the description which follows, and in part will be obvious from the description, or may be learned by practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof, which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Figure 1:
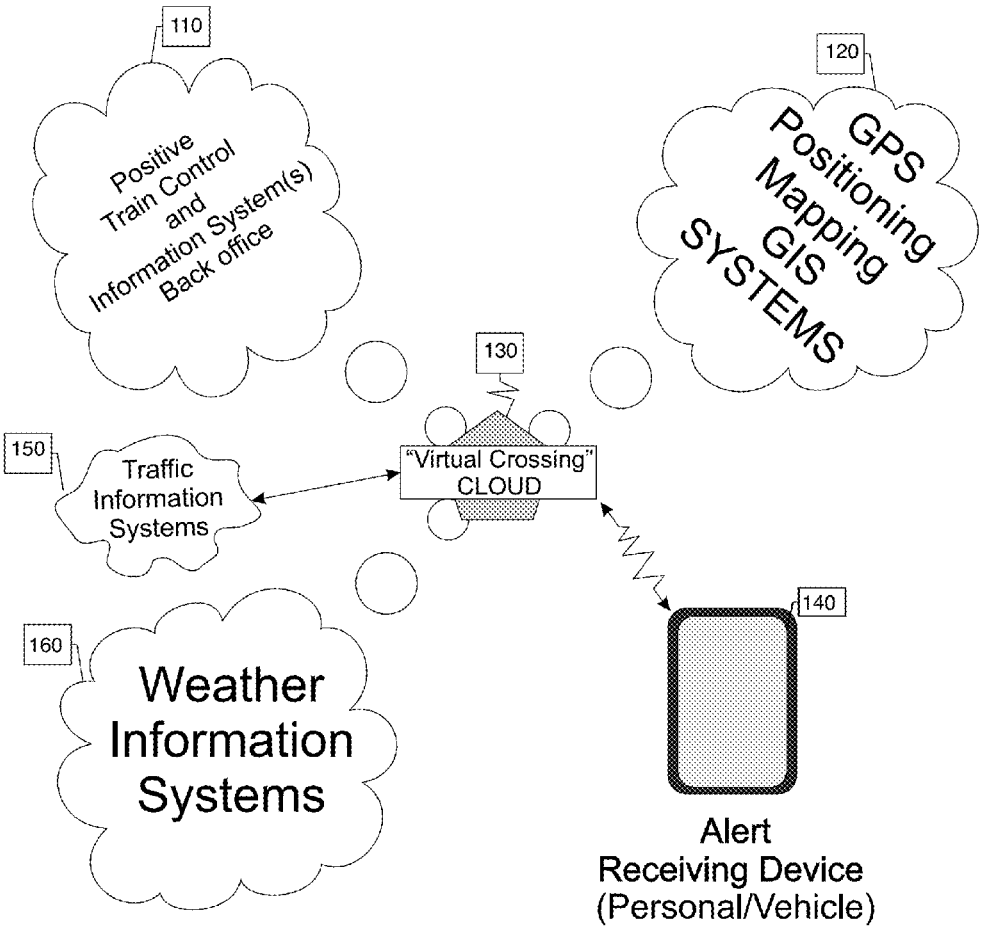
FIG. 1 illustrates an exemplary virtual crossing alert system of the present invention.

Various embodiments of the invention are described in detail below. While specific implementations involving various hardware and software components (e.g., smart phones, tablet and portable computers) are described, it should be understood that the description here is merely illustrative and not intended to limit the scope of the various aspects of the invention. A person skilled in the relevant art will recognize that other components and configurations may be easily used or substituted than those that are described here without parting from the spirit and scope of the invention.

For the sake of brevity, conventional data networking, application development and other functional aspects of the systems (and components of the individual operating components of the systems) may not be described in detail. The connecting lines shown in the various figures are intended to represent exemplary functional relationships and/or physical couplings between various elements. It should be noted that many alternative or additional functional relationships or physical connections may be present in a practical system.

The invention may be described in terms of functional block components, optional selections and various processing steps. It should be appreciated that such functional blocks may be realized by any number of hardware and/or software components configured to perform the specified functions. For example, the invention may employ various integrated circuit components, e.g., memory elements, processing elements, logic elements, audio and/or visual elements, input/output elements, wired or wireless communication techniques, and the like, which may carry out a variety of functions under the control of one or more microprocessors or other control devices.

Similarly, the software elements of the invention may be implemented with any programming, scripting language or web service protocols such as C, C++, C#, Java, COBOL, assembler, and the like. As those skilled in the art will appreciate, the software and hardware elements may be implemented with an operating system such as Microsoft Windows®, UNIX, Apple OS X, MacOS, Linux, Android and the like.

As will be appreciated by one of ordinary skill in the art, the system may be embodied as a customization of an existing system, an add-on product, upgraded software, a stand alone system, a distributed system, a method, a data processing system, a device for data processing, and/or a computer program product. Accordingly, the system may take the form of an entirely software embodiment, an entirely hardware embodiment, or an embodiment combining aspects of both software and hardware. Furthermore, the system may take the form of a computer program product on a computer-readable storage medium have computer-readable program code means embodied in the storage medium. Any suitable computer-readable storage medium may be utilized, including hard disks, CD-ROM, optical storage devices, magnetic storage devices, and/or the like.

The computer program instructions may be loaded onto a general purpose computer, special purpose computer, or other programmable data processing apparatus to produce a machine, such that the instructions execute on the computer or other programmable data processing apparatus create means for implementing the functions specified in the flowchart block or blocks. The computer program instructions may also be loaded onto a computer or other programmable data processing apparatus to cause a series of operational steps to be performed on the computer or other programmable apparatus to produce a computer-implemented process such that instructions which execute on the computer or other programmable apparatus provide steps for implementing the functions specified in the flowchart block or blocks.

FIG. 1 illustrates an exemplary virtual crossing alert system 100 of the present invention. In its embodiments, a virtual crossing alert system comprises a railroad information system 110, a position acquisition system and mapping system 120, an integration system 130, and an alert receiving system 140. Depending on the embodiment, a virtual crossing alert system may optionally include a traffic information system 150 and/or a weather information system 160. Depending on the physical configuration, these systems may use a variety of methods to communicate with each other. For example, in some embodiments, the systems may communicate over one or more networks using protocols suited to the particular system and communication. As used herein, the term "network" shall include any electronic communications means which incorporates both hardware and software components. Communication among the systems may be accomplished through any suitable communication channels, such as, for example, a telephone network, a telecommunication network (e.g., including 3G, 4G standards), fiber optic based network, a radio based network, an extranet, an intranet, Internet, portable computer device, personal digital assistant, smartphone device, online communications, satellite communications, off-line communications, wireless communications, transponder communications, infrared communications, a broadcast network, microwave communications, WiFi communications, Bluetooth, local area network, wide area network, networked or linked devices, keyboard, mouse and/or any suitable communication or data input modality. In some embodiments, part of one system may be integrated with another system. For example, the positioning system and the mapping system may be integrated into a single system to perform both functions. As another example, positioning information may be received from both the railroad information system and a separate positioning system and be integrated in the mapping system. In other embodiments, one or more of the systems are contained within a single physical unit and appropriately coupled through various integrated circuit components.

The railroad information system 110 includes any hardware and/or software suitably configured to monitor and provide train information to the virtual crossing alert system. The railroad information system 110 monitors and train movement through a particular system of trains and track and collects various information regarding such movement. For example, such systems may monitor and collect attributes such as location, direction, speed, and consist size of trains, operator information, location of repair crews and service vehicles, speed restrictions of tracks, condition of tracks, status and condition of wayside signals. One such exemplary system known in the railway industry is the Positive Train Control System. While there are other systems for monitoring train movement and information well known in the art, theses system will not be described in further detail. Any system that monitors train movements, track conditions, and wayside signal status and conditions and collects and provides such information to another system are within the spirit and scope of the present invention.

The position acquisition and mapping system 120 includes any hardware and/or software suitably configured to acquire the identification and location information of the various actors within the virtual crossing system, such alert receiving devices 140, trains, and vehicles and translate this information, so that mapping information regarding the locations of the various actors within the virtual crossing alert system can be produced and accessible to the virtual crossing alert system. For example, Global Positioning Systems (GPS), cellular, radio, Wi-Fi, digital compasses, quantum position, railroad systems and other similar technologies may be used to ascertain the location and identification of the actors in the system. These systems will not be described in detail, but any system that can acquire positioning of objects such trains, tracks, vehicles, and alert receiving devices are within the spirit and scope of the invention.

Mapping technology such as Google Maps, Apple Maps, digital maps, CAD/GIS (geographic information system) and the like acquires the data from the position acquisition system and translates the data into a map that can monitor and track the various actors relative to each other within the mapped location. In some embodiments, the map would result in a visual representation sent to a display for consumption by a person. In other embodiments, the "map" is a digital representation of a particular area that monitors relative positions within the area of interest. These systems will not be described in detail, but any system that can obtain positioning information for multiple actors within an area of interest and can map such information is within the spirit and scope of the invention.

An alert receiving system 140 includes any hardware and/or software suitably configured to receive information from the other subsystems within the virtual crossing alert system and provide a notification, a display, or a command to another device based such information received. Exemplary devices are smart phones, cell phones, vehicle electronic control modules (ECM), laptops, tablets, watches, electronic activity trackers (e.g., Fitbit) and the like. These systems will not be described in detail, but any system that receives alert information and provides a notification, a display, or a command to another device based on the information is within the spirit and scope of the invention.

Figure 2:
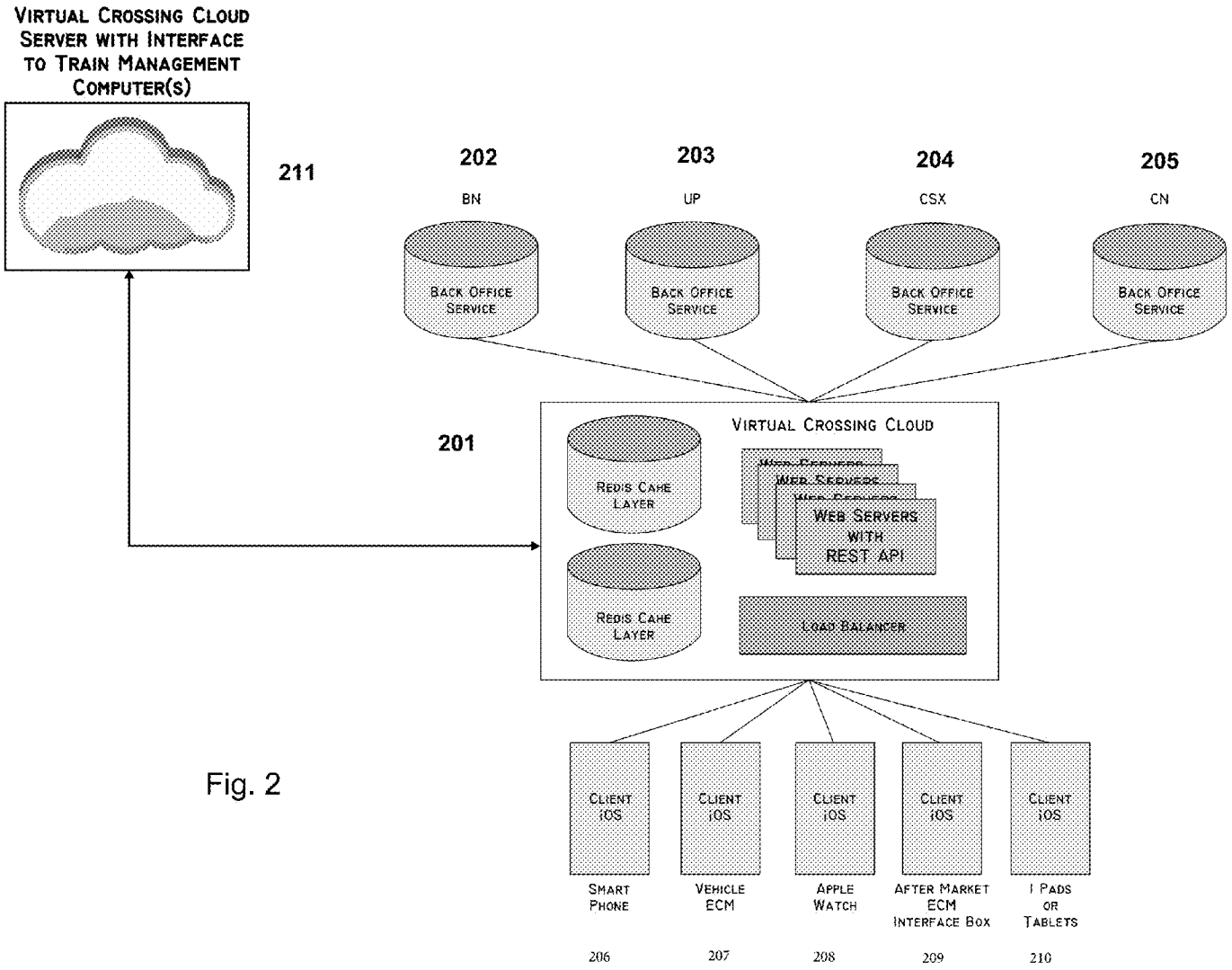
FIG. 2 illustrates an exemplary integration system architecture.

An integration system 130 includes any hardware and/or software suitably configured to receive and send information to the other subsystems with the virtual crossing alert system. In an exemplary embodiment, the integration system is cloud-based. The integration system acts as the information integration and analysis hub of the virtual crossing system. The system may employ one or more applications implementing the features of the system configured to work together on one or more specially-programmed computers. The system may communicate with other subsystems via a network, whether wired or wireless, depending on the particular needs of a subsystem. FIG. 2 illustrates an exemplary integration system architecture. The integration system 201 communicates with various railroad information systems 202-205 to retrieve information regarding the various trains and other actors monitored by those systems. The integration system 201 communicates with various clients 206-210 to receive and transmit location information and zone information for the various actors within the virtual crossing system. The integration system also interfaces with a train management system 211 (e.g., PTC) to retrieve needed information or issued commands to the system. The integration system may also be distributed amongst the subsystem to accomplish the goals of the system. For example, part of the features or functions (described below) may occur at the integration system and a smart phone.

Figure 3:
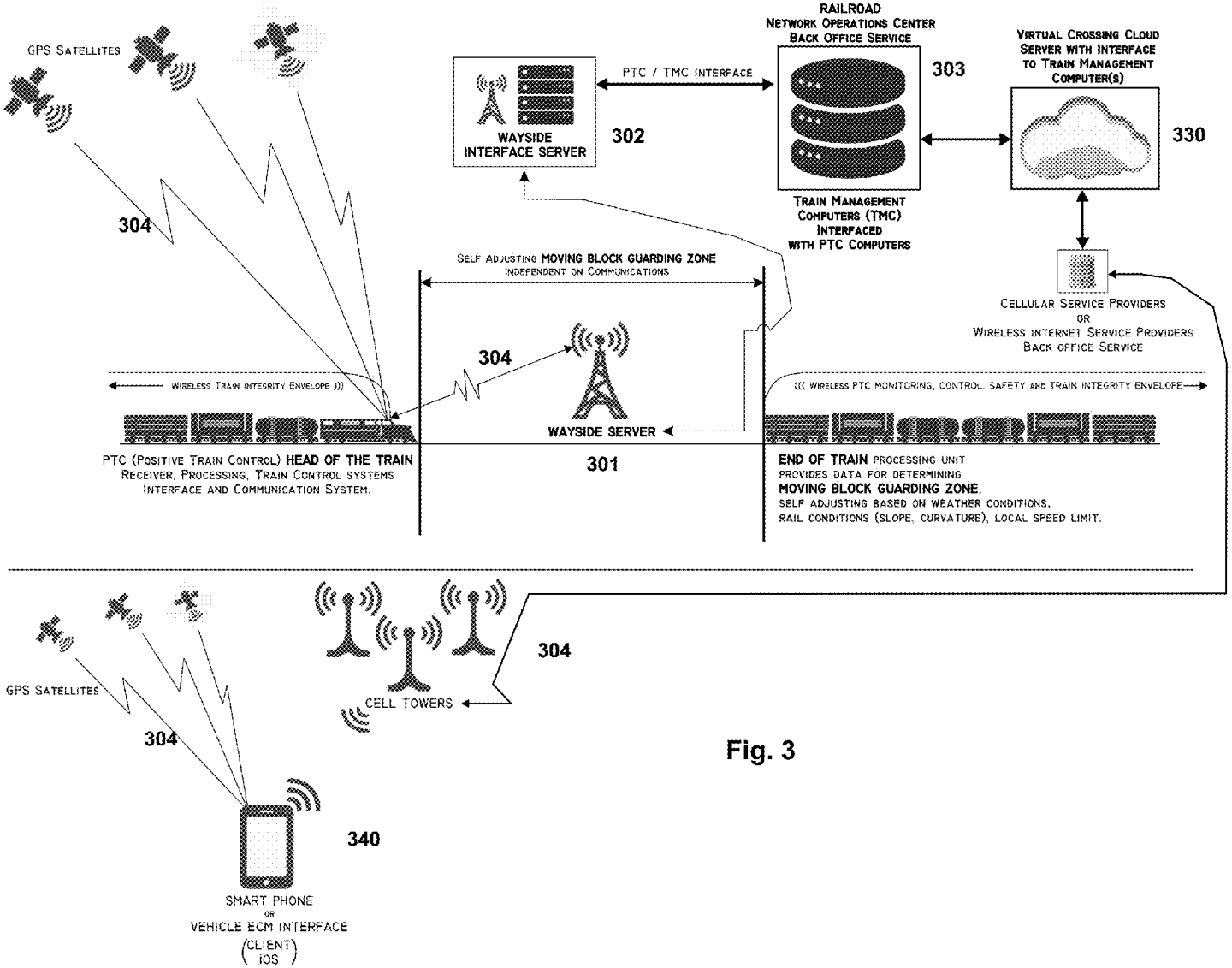
FIG. 3 illustrates an exemplary digital zone constructed in front and back of a moving train.

In its embodiments, the integration system 130 constructs digital representations of areas or "zones" around one or more actors monitored by system including trains and devices of the alert receiving system 140. The digital construction of the zones facilitates the actuation of an alert, notification, or command to the receiving device. An alert may take many forms, for example, an audible sound, a visual indicator, or a control command. Depending on the specific application, any number of zones may be digitally created around any number of actors within the system. When these zones interact, various alerts, notifications, or commands may be sent to the alert receiving system 140. FIG. 3 illustrates a zone constructed in front and back of a moving train. In this exemplary embodiment, the position of the train is communicated to a wayside server 301 and to wayside interface 302. The railroad information server, in this case, a PTC interface, communicates the train's information (e.g., location and speed) to the railroad's network operations center 303. This information is received by the integration system 330 and communicated to an alert receiving system 340 through one or more networks 304. A similar zone is constructed around an alert receiving device. The size of the zones, in the case of the train or the alert receiving device, may be influenced by ground speed (train and device), weather conditions, local topography and the like.

The integration system 330 ascertains the location of a particular alert receiving device 340. The integration system may continually poll the particular device for its position information or the device may send position information to the server (e.g., location, speed, or route). The time between requests, either by the server or the device, can be preset or determined according to the particular application. The integration server receives the current position information of the alert receiving device and correlates this information with the position information of nearby trains.

Depending on the positional relationship of the digitally constructed zones of the two actors (i.e., train and device), one or more alerts, notifications, or command may be sent at various times during the this monitoring relationship. For example, if the zones are intersecting and a collision is imminent, the integration system may send a comment to the alert receiving device. This command may cause the device to provide an audio or visual alert, e.g., to vibrate or sound an alert or to show a "collision icon" on a display. The types of alerts, notifications, and command will depend on the particular application of the system. For example, in an application where the alert receiving device is an ECM, the integration system may send a command to the ECM to brake the vehicle. In an application where the alert receiving device is a smart phone being held by a user (e.g., taking a walk), the integration system may send a command that cause the smartphone to vibrate. In some embodiments, the integration system 130 may also issue commands to the railroad information system 110 so the system may issue a brake command to the train. In other embodiments, the train may be configured with an alert receiving device so that operation of the train can remain local to the train.

In another embodiment, the alert receiving device requests and receives position information from the integration system. In this embodiment, the alert receiving device is specially programmed with features of the integration system to perform the zone position analysis. Whether the integration system requests information from the alert receiving device, or vice versa, will depend on the particular application and the capabilities of both the specially programmed hardware of the two systems (e.g., processor speed, bandwidth available). In some embodiments, the system may "switch" between both modes depending on the conditions at either system.

The zones constructed around the various actors within the system will have varying characteristics depending on the application and the actor. Many factors can influence the size of the zones such as speed, location, size and/or weight of the actor, environmental conditions (e.g., weather), topography, track conditions, road conditions and the like. For example, a zone constructed around a train moving through a populated area may be larger than if the train is in the country (i.e., zone size dependent upon location of the actor). A zone constructed around an alert device used by a person walking will be smaller than if that person is in a car (or the alert device is attached to the car). Depending on the application, the zones be static or dynamic.

Figure 3A:
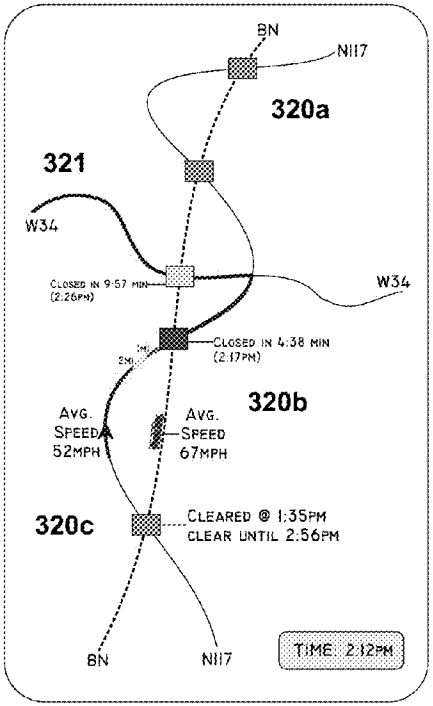
FIG. 3A illustrates an exemplary display of information within a mobile display of the virtual crossing system.
Figure 3A:
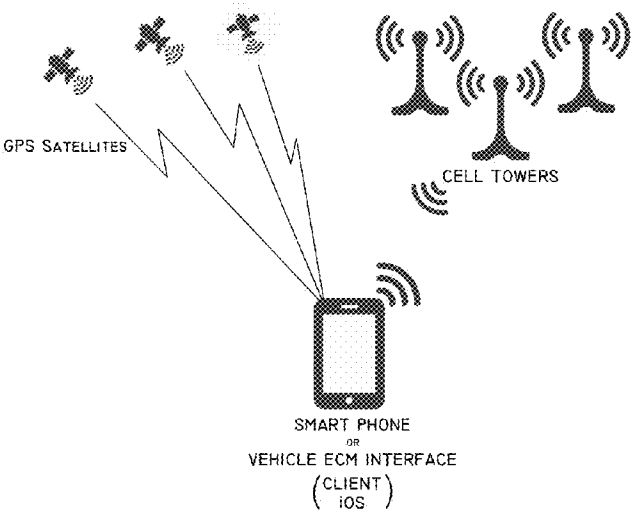

FIG. 3A illustrates an exemplary display of information within a mobile display of the virtual crossing system. Multiple crossings within a specified area 320*a-c* are displayed along with their status based on the interaction of the zones of the actors within the area. As indicated, the expected time of arrival at each crossing can be estimated and displayed based on the current route 321 information of the alert receiving device.

Figure 3B:
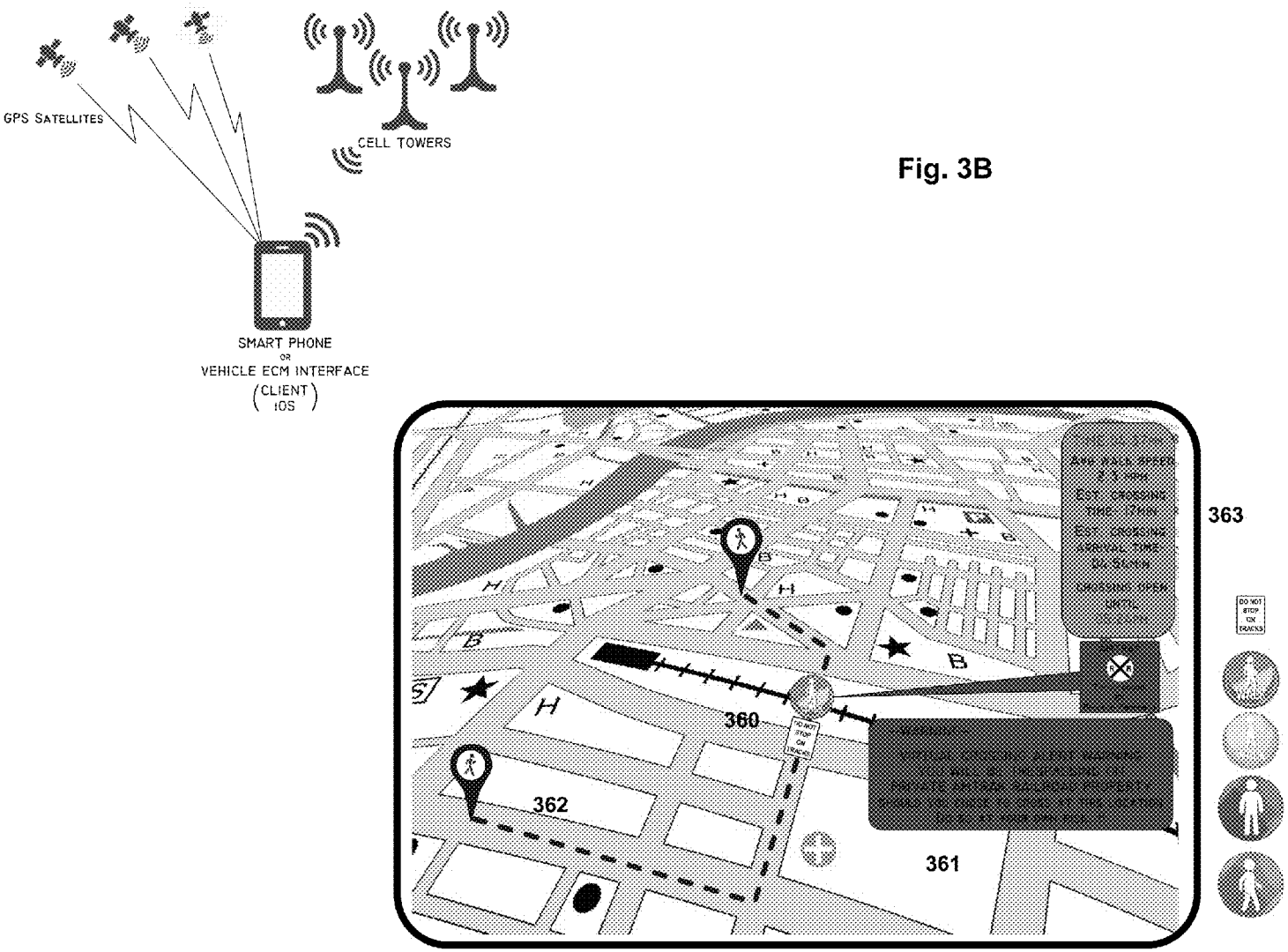
FIG. 3B illustrates an exemplary operation and display of information in an exemplary walking embodiment.

FIG. 3B illustrates an exemplary operation and display of information in an exemplary walking embodiment. Similar to FIG. 3A, a crossing 360 is identified in the display (of a mobile device, such as a smart phone or a tablet). When a user equipped with an alert receiving device (e.g., an application on the smart phone or tablet) is approaching a railroad crossing, an alert or notification may be issued during various stages on the walk 361. In this embodiment, a user indicates a route on the alert receiving device (via manual input or voice entry). The user's current location is then ascertained and mapped on the display 362. Because a railroad crossing is within the specified area (in this embodiment, determined by the display), the alert receiving system is made aware of the railroad crossing and its constructed zone. Based on parameters such as walking speed and route, the device may display various information such as speed, railroad crossing arrival time, and if the crossing is able to be crossed 363. Any number of characteristics may be displayed depending on the application, such as speed, travel time, estimated arrival, crossing status, alert status, weather conditions, traffic conditions, train or crossing characteristics and the like.

Figure 4A:
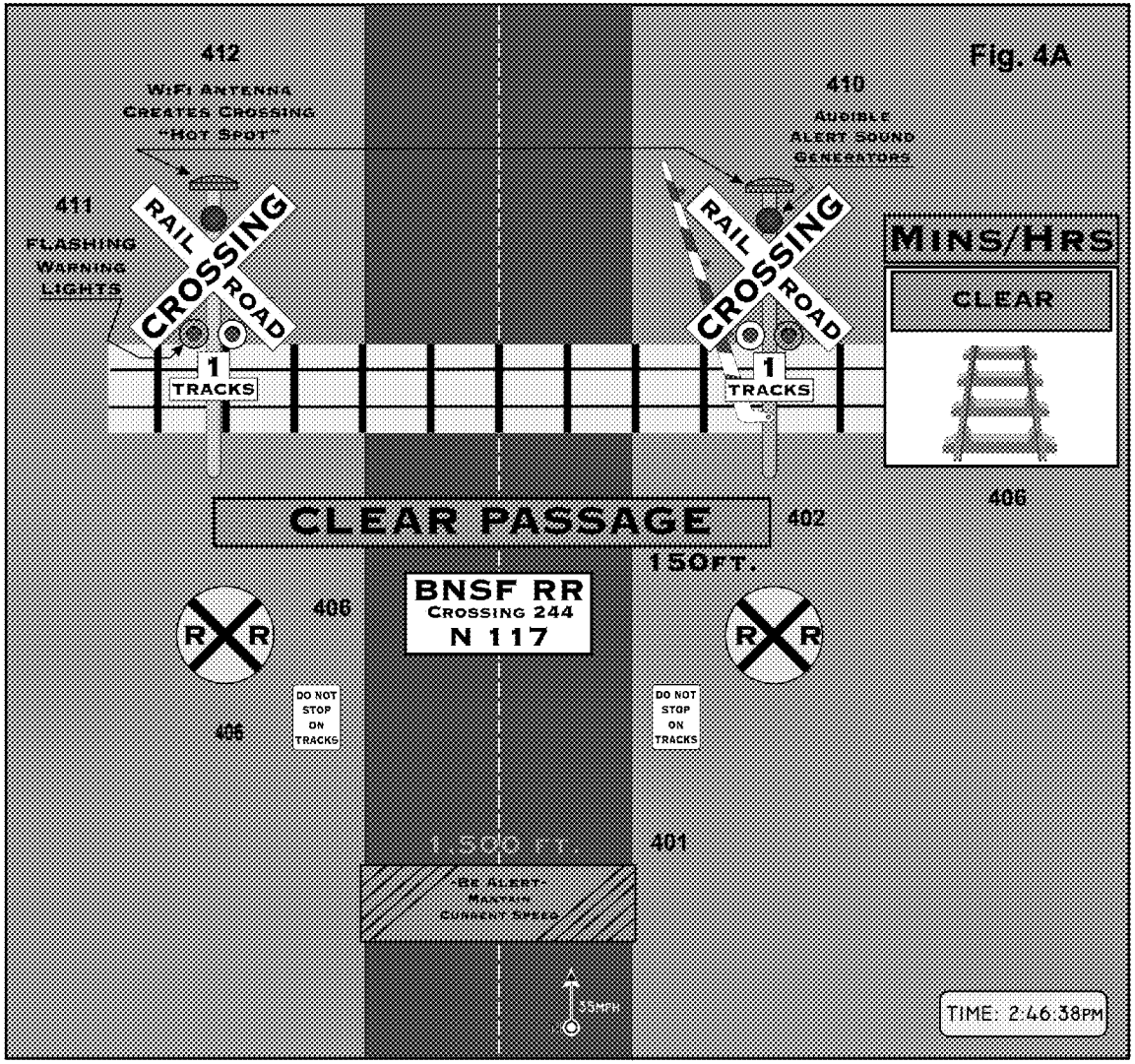
FIG. 4A illustrates operation of the virtual crossing system in an exemplary train crossing embodiment when safe to cross.
Figure 4B:
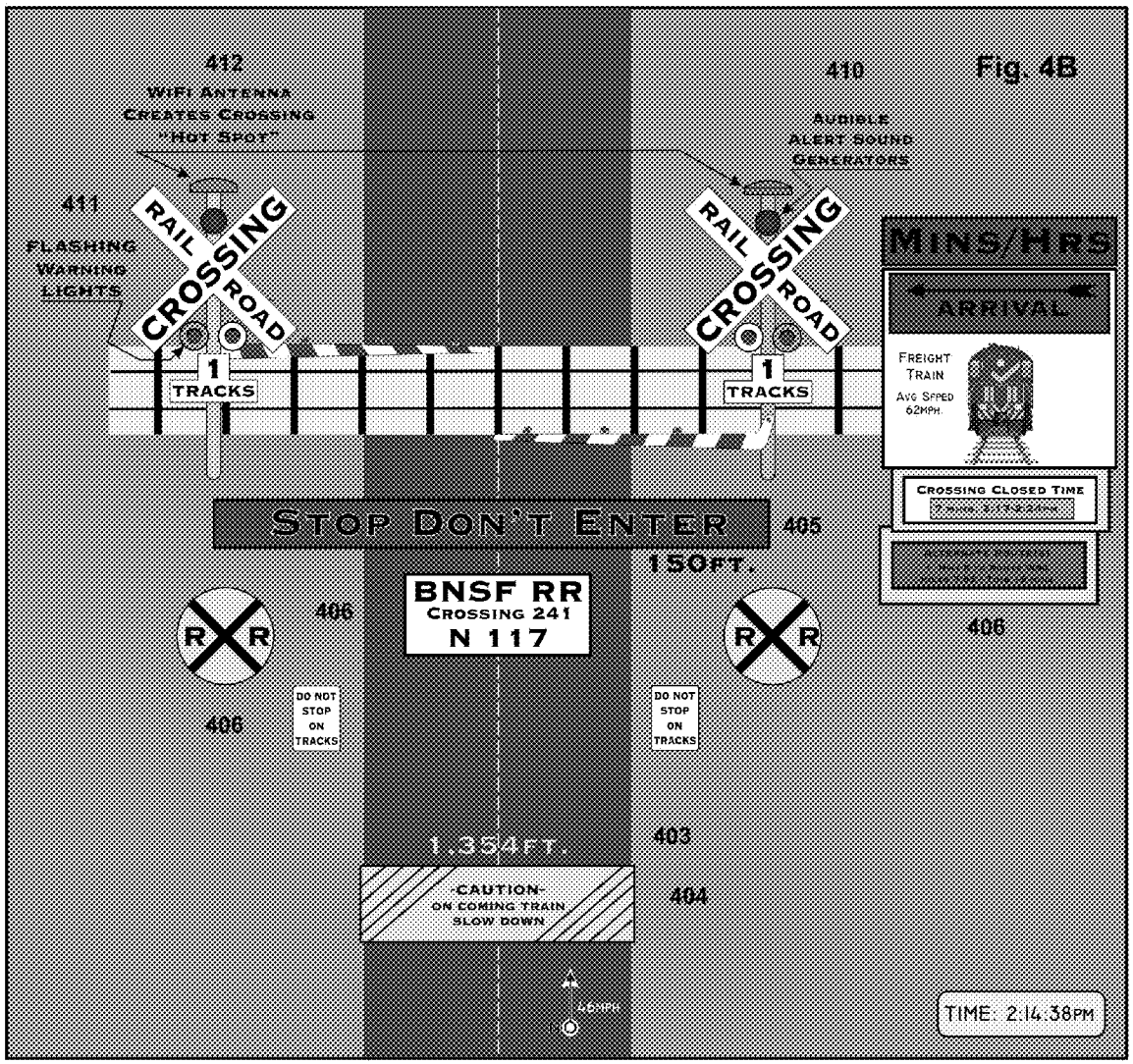
FIG. 4B illustrates operation of the virtual crossing system in an exemplary train crossing embodiment when not safe to cross.

FIG. 4A-4C illustrates the operation of the virtual crossing system in an exemplary train crossing embodiment. In FIG. 4A, a zone is constructed around a fixed area, e.g., the train crossing. At 1,500 feet from the track crossing 401, the alert receiving device is receiving a "Clear Passage" notification 402 because there is no other actor within the distance (or expected to be within that distance) of the alert receiving device. FIG. 6B illustrates the expected arrival of a train, which is traveling at 62 mph, at the crossing. At 1,354 feet from the track crossing 403, the alert receiving device, which is traveling at 46 mph, is issued a "Caution" 404 and "Stop Don't Enter" 405 notification. In this instance the oncoming train's zone and the alert receiving device's zone are interacting to create the notifications.

Additionally, visual and audio alerts may be utilized at the railroad crossing that are actuated by the integration system or the alert receiving system. For example, the crossings may employ audible sound generators 410 or flashing warning lights 411 that are actuated according to parameters set by the integration or alert receiving systems. A "Wi-Fi" 412 hotspot may be employed at the crossing to assist in bettering wireless coverage in needed areas.

Also, FIGS. 4A-4B illustrate how a display of some of the information available within the virtual crossing system, e.g., in a vehicle display or smart phone. In an exemplary embodiment, animated icons represent locations where the integration system interfaces with a vehicle's ECM. In this case, the integration system also issues command to the display and the ECM. For example, the integration system may take over control of the vehicle through its ECM and may slow the vehicle down or stop it completely depending on the crossing's conditions. Icon alerts 406 can also be employed that correlate to parameters used by the system to alert or notify the alert receiving systems at particular distances from intersecting (or possibly intersecting) zones of other actors within the system.

As stated above, an optional system is a traffic information system 150 that includes any hardware and/or software suitably configured to provide road traffic information to the alert receiving system. The traffic information system provides local traffic information to the integration system so that traffic conditions may be integrated into creating zones around various actors.

As stated above, an optional system is a weather information system 160 that includes any hardware and/or software suitably configured to provide current weather information to the alert receiving system 160. The weather information system provides local weather information to the integration system so that traffic conditions may be integrated into creating zones around various actors.

A method of constructing zones around various actors within a virtual crossing system. The method includes the steps of: for actors within a specified area, receiving at a specially programmed computer, train information from a railroad information system, receiving at the computer, positioning and mapping information, and receiving, at the computer, alert receiving device information. The specially programmed computer digitally constructs zones around each actor in the specified area. When one or more zones intersect, the specially programmed computer issues an alert, a notification, or a command based one or more parameters. An alert receiving device receives the alert, notification, or command and executes an audio, visual, or vibratory action.

Although the above description may contain specific details, they should not be construed as limiting the claims in any way. Other configurations of the described embodiments of the invention are part of the scope of this invention. The descriptions and embodiments are not intended to be an exhaustive or to limit the invention to the precise forms disclosed. Accordingly, the appended claims and their legal equivalents should only define the invention, rather than any specific examples given.

What is claimed is:

1. A virtual crossing system comprising:

one or more networks;

a positive train control system, a positioning and mapping system, an alert receiving system, and an integration system wherein the integration system receives train information from the positive train control system over the one or more networks and constructs a first digital zone around the train, wherein the integration system receives location information from the alert receiving system over the one or more networks and constructs a second digital zone around the alert receiving device, and wherein the integration system issues at least one of an alert, a notification, and a command depending on (i) when the first digital zone intersects the second digital zone or (ii) when the first digital zone is expected to intersect the second digital zone, according to defined parameters.

* * * * *